United States Patent [19]

Simon

[11] 3,978,466

[45] Aug. 31, 1976

[54] ALARM SYSTEM INCLUDING REMOTE SIGNALLING MEANS

[76] Inventor: Theodore Simon, 9 Maplewood Drive, Plainview, N.Y. 11803

[22] Filed: Sept. 22, 1975

[21] Appl. No.: 615,833

[52] U.S. Cl. ..... 340/274 R; 340/213 R; 340/276

[51] Int. Cl.[2] ..... G08B 13/08

[58] Field of Search ..... 340/213 R, 216, 274 R, 340/276, 409, 412, 420

[56] References Cited

UNITED STATES PATENTS

| | | | |
|---|---|---|---|
| 3,084,338 | 4/1963 | Mauer et al. | 340/412 X |
| 3,470,554 | 9/1969 | Corbell | 340/409 X |
| 3,711,854 | 1/1973 | Reynolds et al. | 340/409 |
| 3,924,256 | 12/1975 | Cohen | 340/274 R |

*Primary Examiner*—Alvin H. Waring
*Attorney, Agent, or Firm*—Lackenbach, Lilling & Siegel

[57] ABSTRACT

An improved alarm system is disclosed which includes one or more remote stations. Each remote station is connected to the central or control station by only three conductors or leads. The control and remote stations each include a pair of back-to-back LED diodes, the diodes of each pair emitting a different color light when current flows therethrough. The control and remote stations each also includes a key switch which is operative to "enable" and "disable" the alarm circuitry at the control station. By controlling the direction as well as the wave shape of the currents passing through the LED diodes, four different visual signals may be provided at the control and remote stations to indicate the status of the alarm system. Actuation of any of the key switches reverses the current through the LED diodes so that the different colors are indicated when the alarm system is "enabled" or "disabled". Pulsing means is provided at the control station for producing either a constant current through the LED diodes when an alarm condition does not exist, and a pulsed current when an alarm condition is generated. The current in each direction can be pulsed through the LED diodes so that each pair of back-to-back diodes can emit four distinguishable visible signals indicative of different conditions of the alarm system. A fifth indication may be provided by essentially the same circuitry when a parallel delay loop is provided in addition to the main loop to indicate the condition of the delay loop.

13 Claims, 4 Drawing Figures

| LOOP | RELAY CONTACT | CURRENT |
|---|---|---|
| CLOSED | CLOSED | NO CURRENT FLOW |
| CLOSED | OPEN | CONSTANT CURRENT THROUGH $d_2$ |
| OPEN | CLOSED | PULSED CURRENT THROUGH $d_1$ |
| OPEN | OPEN | PULSED CURRENT THROUGH $d_2$ |

ALARM SYSTEM INCLUDING REMOTE SIGNALLING MEANS

BACKGROUND OF THE INVENTION

The present invention generally relates to alarm systems, and more specifically to an alarm system which includes one or more remote stations connected to a control station by only three leads but which nevertheless permits remote control of the alarm system and which provides numerous visual indications of the status of the alarm system at the central as well as remote locations.

There are numerous alarm systems, including intrusion as well as fire, already known. While the basic circuitry of such alarms is relatively simple, many of the known alarms incorporate means for increasing the effectiveness of the alarm system, decreasing the number of false alarms, minimizing power consumption or prevention of tampering with the system. Typical alarms of the aforementioned types are disclosed in U.S. Pat. Nos. 3,351,934; 3,641,552 and 3,828,340.

The use of remote stations which permit supervision of the alarm system are also known. With such an arrangement, there is typically provided a central control box which includes the bulk of the circuitry of the system as well as the power supplies and stand-by batteries for energizing the system. The control boxes are normally concealed and locked so that tampering therewith is not possible without actuating the alarm. When remote stations are provided, these are connected to the control box and permit limited control of the alarm system. Sometimes, the remote stations provide an indication of the status of the alarm system. U.S. patents which disclose alarm systems having remote stations are U.S. Pat. Nos. 3,174,143, and 3,747,093. The use of LEDs in alarm systems is also known and disclosed in U.S. Pat. No. 3,706,987.

As is well known to those skilled in the art, a major expense involved in the installation of alarm systems is the labor required to wire the electrically conductive leads or wires throughout the premises to be protected. When remote locations are utilized, these must clearly also be wired to the control box, and this involves additional time and expense. In this connection, an objective of numerous prior art alarm systems has been to connect the remote stations which cooperate with the central control box by the minimum number of leads while providing the maximum amount of control or supervision over the alarm system, as well as providing the maximum number of indications of the status of the alarm system. The invention to be described permits the use of only three leads to connect each remote station to the control station while providing four or five distinct visual indications of the status of the alarm system, as well as providing supervisory control over the system to permit the same to be enabled or disabled from any of the remote locations. The known alarm systems have not provided such extensive information concerning the status of the alarm system, as well as providing control of the system at the remote locations when the remote stations have been connected to the control station by only three leads or conductors.

SUMMARY OF THE INVENTION

It is an object of the present invention to provide an alarm system which does not have the above-described disadvantages associated with the prior art known systems.

It is another object of the present invention to provide an alarm system which permits supervisory control at remote locations as well as numerous indications concerning the status of the alarm system at the remote locations.

It is still another object of the present invention to provide an alarm system as in the last object which is both simple in construction and economical to manufacture.

It is yet another object of the present invention to provide an alarm system as in the above objects, wherein the remote stations are connected to the central control station by only three leads while providing supervisory control as well as four or five distinct visual indications concerning the status of the alarm system at each of the remote stations.

The alarm system of the present invention includes an alarm circuit and alarm sensing means, the state of which is changable between a non-alarm condition and an alarm condition. According to the present invention, the alarm system comprises pulsing means connecting to said alarm sensing means for generating a substantially constant voltage in said non-alarm condition and a pulsating voltage in said alarm condition of said alarm sensing means. Switch means is provided for enabling and disabling the alarm circuit and for providing higher and lower reference voltages as a function of the enabled and disabled conditions of the alarm circuit. Indicating means are provided connected between said pulsing and switching means and adapted to permit current flow in each of two opposite directions therethrough as the function of the relative voltages provided by both said pulsating and switching means across said indicating means. Said indicating means provides a different indication for each of the two directions of current flowing therethrough. In this manner, a total of four indications may be obtained by selective passage of currents through said indicating means which currents may flow in one of the two opposing directions and which may be constant or pulsed in each of said directions to thereby provide said two different indications each in either constant or in pulsed form.

Further switch means is provided for enabling and disabling the alarm system. The indicating means as well as said further switch means are connected between said pulsing and switching means by only three leads or conductors. Where remote stations are provided, each of the remote stations includes indicating means and further switch means connected in parallel to the first-mentioned indicating means and further switch means by only three leads, each remote station permitting supervisory control over the alarm system as well as providing the numerors visual indications which are provided at the control station.

Other objects and advantages of the invention will become apparent from the following detailed description, reference being made to the accompanying drawings.

DESCRIPTION OF THE PREFERRED EMBODIMENT

Figure 1:
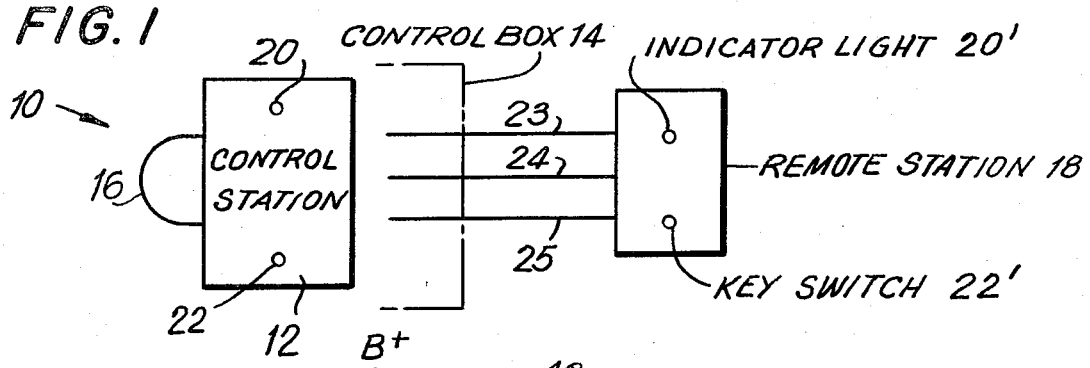
FIG. 1 is a schematic representation of an alarm system in accordance with the present invention, showing a remote station having an indicator light and a key switch connected to a central or control station by only three leads.

Referring to the figures, wherein similar or identical parts referenced by the same reference numerals throughout, and first referring to FIG. 1, an alarm system in accordance with the present invention is generally designated by the reference numeral 10.

The alarm system 10 includes a control station 12, the circuitry of which is generally housed within a control box 14 which is made tamper proof and concealed.

Most present-day alarm systems are "closed loop" systems. Such a closed loop is designated by the reference numeral 16 in FIG. 1, such a loop generally being preferred because it is somewhat more effective and tamper proof than "open loop" systems. While the closed loop alarm systems require a continuous flow of current through the loop during the non-alarm condition, these currents can be made sufficiently small so that there is minimal drain on the source of electrical energy. Closed loops used for intrusion alarms typically include switches at the openings to the premises, including doors and windows, which switches are closed during the non-alarm condition or when the openings are also closed. When one of the openings is violated, the respective switch associated with that opening opens to break the loop to interrupt the current flow therethrough. Such termination of current flow is detected by the alarm system and suitable visual or audio indications may be provided. The opened loop is designated by the reference numeral 16' in FIG. 2.

An important feature of the present invention is the provision of one or more remote stations 18, each of which includes the maximum supervisory control as well as remote indications concerning the status of the alarm system while being connected to the control station by only three electrical conductors or leads. Accordingly, the remote station 18 includes an indicator light 20 and a key switch 22, the remote station 18 being connected to the control station by means of only three electrical conductors or leads 23–25. As to be more fully described hereafter, the key switch 22 permits the alarm system 10 to be enabled or disabled at any remote station. Additionally, the indicator light 20 provides at least four distinct visual indications concerning the status of the alarm system.

Figure 2:
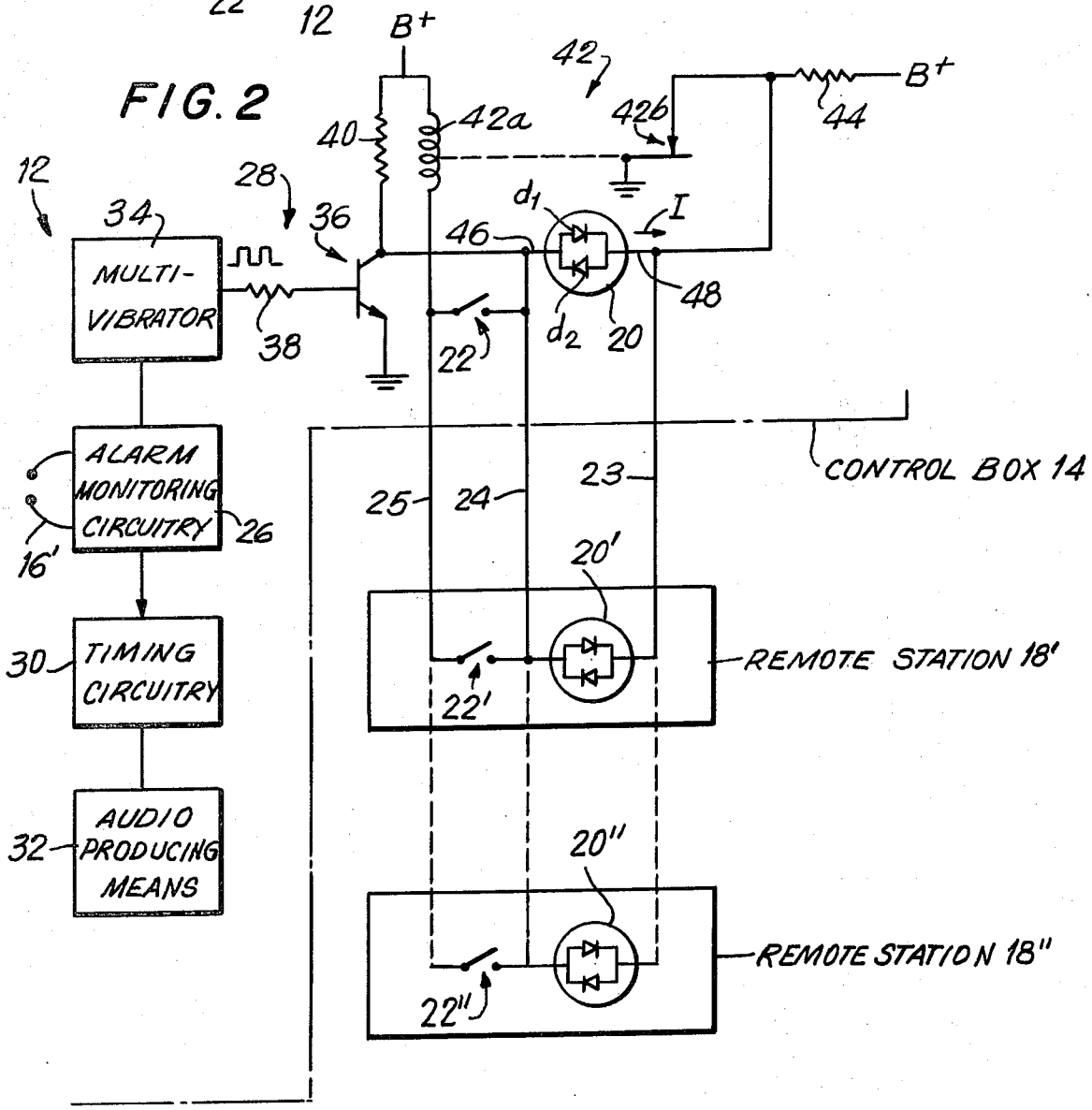
FIG. 2 is a schematic representation, partially in block diagram form, showing the details of the control station and remote station shown in FIG. 1, and further showing the manner in which a plurality of remote stations are connected parallel to each other and connected to the control station by only three leads or conductors.

In FIG. 2, the control station 12 is shown to include an alarm monitoring means 26 which is connected to the open loop 16' during an alarm condition. The alarm monitoring circuitry 26 typically includes means for driving a current through the normally closed loop 16 as well as means for detecting when such current flow has terminated due to a violation of the loop or one of the protected entrances or openings.

The alarm monitoring circuitry 26 is connected to pulsing means generally designated by the reference numeral 28, to be more fully described below. Advantageously, the alarm monitoring circuitry 26 is also connected to timing circuitry 30 which in turn is connected to audio producing means 32. As will be described below, visual indications are provided concerning the status of the alarm system 10. However, as with most known alarm systems, there is advantageously generated a loud audio signal upon the actuation or energization of the alarm system during the alarm condition. Such a loud sound is intended to frighten the person who has violated one of the openings and therefore the closed condition of the loop 16, in the case of burglary, or to alarm the inhabitants of the dwelling in the case of a fire. Such a loud sound is most effective during the first few moments and continued generation of such loud sound frequently serves no useful purpose. Accordingly, the timing circuitry 30 is advantageously adjusted so that upon the generation of an alarm condition the audio producing means 32 is energized for only a predetermined time period, such as for example fifteen minutes. After such time interval, the audio producing means is de-energized so that further sound is terminated. However, the visual indications are advantageously maintained so that information may be obtained as to the present status of the alarm system, namely whether the alarm system is in an enabled or a disabled condition and whether the loop 16 is closed or open.

As described above, the central or control station 12 is connected to the remote stations by means of three leads or conductors 23–25. Referring specifically to FIG. 2, the pulsing means 28 is shown to include a multi-vibrator 34 connected to a transistor 36 by means of a current-limiting resistor 38. It should be clear that any suitable pulsing means may be used and that the pulsing means being described is merely illustrative of the type which has been found satisfactory in this application.

The transistor 36 has a grounded emitter electrode, with the base being connected to the resistor 38. A collector resistor 40 is connected between the collector of the transistor 36 and a source of voltage $B^+$. As is well known, the application of a very low voltage approaching ground potential at the base of the transistor 36 places the transistor in a non-conductive mode and the supply of voltage $B^+$ appears at the collector of the transistor. On the other hand, when a sufficiently positive voltage is applied to the base, typically above several tenths of a volt, the transistor 36 becomes saturated and the collector voltage drops to a potential close to ground potential.

A relay generally designated by the reference numeral 42 is provided which has a relay coil **42*a*, one terminal of which is connected to the source of voltage $B^+$. The relay 42 also has a pair of contacts 42*b* one of which contact is grounded or connected to ground potential and the other contact of which is connected through a resistor 44 to the source of voltage $B^+$. For reasons which will become apparent hereafter, the relay 42 is advantageously a ratchet-type relay which permits successive opening and closing of the contact 42*b* upon each energization of the relay coil 42*a*. Accordingly, subsequent to one energization of the relay coil 42*a*, the contacts 42*b* are, for example, opened or separated and remain open. Upon a subsequent energization, the contacts 42***b* close or come into contact and remain in contact until the realy is again energized.

Connected between the collector of the transistor 36 and a point between the contacts 42*b* and resistor 44 there is provided an indicator light 20 which, in the present invention comprises a pair of back-to-back LED diodes $d_1$ and $d_2$. The diodes $d_1$ and $d_2$ are advantageously packaged in a single housing or encapsulated within a single package, with the anode of $d_1$ and the cathode of $d_2$ forming a terminal 46 while the cathode of $d_1$ and the anode of *d2* forming the terminal 48. Accordingly, the terminal 48 of the indicator light 20 is connected to the collector of the transistor 36 while the terminal 48 is connected to the contacts 42*b* and resistor 44 as above described.

Each of the diodes $d_1$ and $d_2$ is adapted to permit current flow in one direction only. Thus, the diode $d_1$ permits current flow from the collector 36 towards the resistor 44 while the diode $d_2$ only permits current flow in a reverse direction or from the resistor 44 towards the transistor 36. In accordance with the presently preferred embodiment, the diode $d_1$ generates one color when current flows therethrough, while the diode $d_2$ generates a different and distinct color when current flows through it. Accordingly, depending upon the direction of current flow through the indicator light 20, a corresponding color will be emitted by the indicator light 20.

The key switch 22 is connected between the collector of the transistor 36 and the other terminal of the relay coil 42*a*. Since one terminal of the relay coil is connected to a positive source of voltage $B^+$, it should be clear that the grounding or lowering of the potential of the other terminal of the relay coil to a sufficient degree energizes the relay 42 to alter the condition of the relay contacts 42*b*.

What has been described above is the circuitry within the control station 12. However, each of the remote stations 18' and 18'' similarly includes an indicator light 20', 20'' and a key switch 22', 22'' connected in parallel to the corresponding indicator light 20 and to key switch 22 at the control station. It should be clear that while only two remote stations are shown, any desired number of remote stations may be utilized and connected in parallel across the leads or conductors 23–25 as suggested by the dashed lines in FIG. 2.

The multi-vibrator 34 is connected to the alarm monitoring circuitry 26 as above described. One condition of the alarm circuit 10 is shown in FIG. 2. When the loop 16' is open, well-known circuitry may be utilized to cause multi-vibrator 34 to begin pulsating and generate a square wave as shown in FIG. 2. The output voltage of the multi-vibrator 34 need only fluctuate from approximately ground potential to over several tenths of a volt in order to turn the transistor 36 off and on respectively. When the potential at the base of the transistor 36 drops to near ground potential, the transistor 36 is turned off and the collector voltage rises to approximately $B^+$. On the other hand, when the voltage at the base rises above several tenths of a volt, the transistor 36 becomes saturated and the collector drops to approximately ground potential.

The alarm monitoring circuitry 36 and the multi-vibrator 34 are selected to produce a fluctuating or pulsating voltage as shown only when the loop 16 is open. On the other hand, when the loop is closed, the output of the multi-vibrator 34 is advantageously at the positive as opposed to the ground potential of the fluctuating voltage. Thus, when the loop 16 is closed, a constant or permanent non-fluctuating voltage of over several tenths of a volt appears at the base of the transistor 36. When the voltage at the base of the transistor 36 is maintained at the positive potential, the transistor remains on and the collector voltage thereby remains at the low saturation level near ground potential.

The pulsing means 28, including the multi-vibrator 34 and the transistor 36, thereby control the potential at the terminal 46 of the indicator light 20. The terminal 48 has the potential thereof controlled by the condition of the relay contacts 42*b*. When the contacts are closed as shown in FIG. 2, the terminal 48 is clearly grounded or at zero potential while opening of the contacts 42*b* places a positive potential at the terminal 48 close to $B^+$.

When the potential at the terminal 46 is higher than the potential at the terminal 48, a current will flow only through the diode $d_1$ in the direction indicated by the arrow and marked by I. When the potential across the indicator 20 is reversed, or when the potential at the terminal 48 is higher than the potential at the 46, the current flow is reversed and flows in a direction opposite to that indicated by the arrow.

For purposes of illustration only, the diodes $d_1$ may be selected to generate a green light when current flows therethrough while the diodes $d_2$ generate red light when currents flow therethrough. Clearly, since all the indicators 20, 20' and 20'' are connected in parallel, application of voltage potentials as suggested above simultaneously applies the same voltages across similar terminals on all the indicators and comparable currents flow with resultant comparable colors being emitted by all the indicators at all the remote locations. Similarly, since all the key switches 22, 22' and 22'' are connected in parallel, the closure of any of the key switches is effective to energize the relay coil 42*a* and thereby change the condition of the relay contacts 42*b* as above described.

The operation of the alarm system 10 will now be described to the extend to which it has not been described above. Referring to FIG. 2, the relay contacts 42*b* are shown closed to correspond to the off or disabled condition of the alarm system. Accordingly, the terminal 48 of each of the indicators is grounded. Since the loop 16' is open, indicating an alarm condition, the multi-vibrator 34 is caused to generate a square voltage output at the base of the transistor 36 to thereby turn the transistor on and off and correspondingly apply a fluctuating voltage at the terminal 46. When the potential of the collector drops to near ground potential, little or no voltage appears across the indicators 20, 20' and 20'' and no light is emitted therefrom. However, when the transistor 36 becomes non-conductive, the potential of the terminal 46 is raised to approximately $B^+$ and the current I flows through the diode $d_1$ with the resultant pulsating green light being generated at each of the indicators at the control station 12 as well as at the remote stations 18' and 18''.

Prior to opening of the loop 16, that is with the loop 16 closed, a positive potential appears at the base of the transistors 36 and the terminal 46 is maintained at a low, near ground potential. In this condition, when the contacts 42*b* are closed as shown in FIG. 2, little or no potential appears across the indicator lights and no light at all is emitted therefrom. This condition indicates that the alarm system 10 is disabled and that the loop 16 has not been violated.

Figures 3, 4:
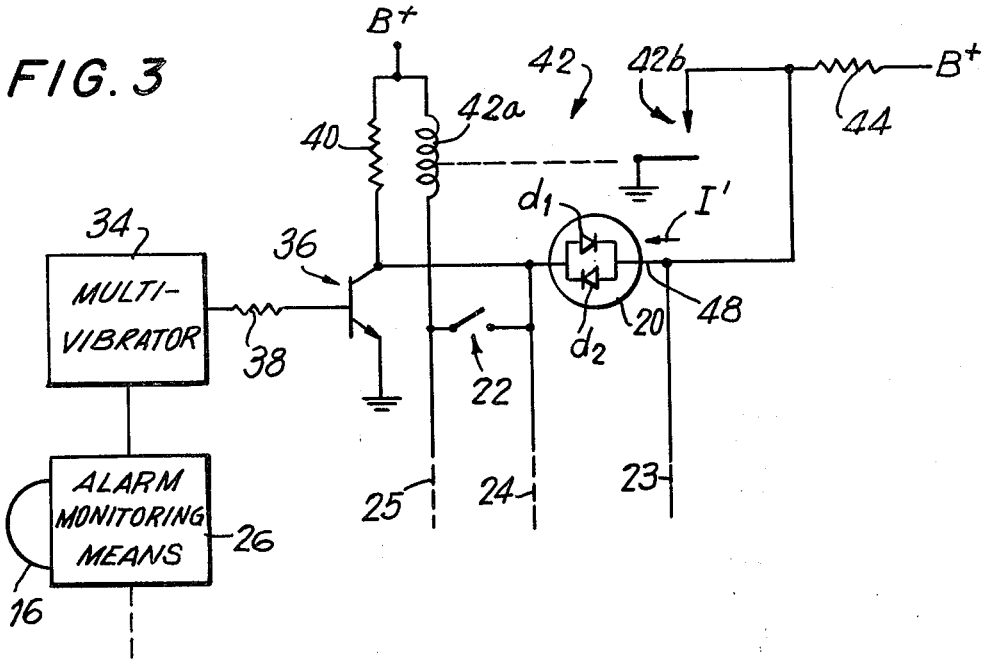
FIG. 3 is similar to FIG. 2, but only showing the details of the alarm system at the control station during a non-alarm condition of the system, as opposed to the alarm condition shown in FIG. 2.
FIG. 4 is a table summarizing the visual indications which are provided at each of the stations, control and remote, during different conditions of the alarm system.

When any of the key switches 22, 22' or 22'' are closed, the relay contacts 42*b* are opened and maintained open to raise the potential at the terminal 48 of the indicator lights. Now, when the loop 16 is closed as shown in FIG. 4, a positive potential appears at the base of the transistor 36, thus lowering the potential at the terminal 46 and a constant current I' flows through the diode $d_2$ to cause a constant red light to be emitted at each of the stations. The constant red indication signifies that the alarm system 10 is enabled but that the loop 16 has not been violated and that therefore all the openings of the protected area are closed. Opening of the loop 16 with the contacts 42*b* open causes a pulsating current to flow through the diode $d_2$ due to the flutuating voltage at the collector of the transistor 36. Such a pulsating red light indication at each of these stations signifies that the alarm system is enabled and additionally that the loop 16 has been violated and that therefore at least one of the openings to the premises is open.

The above-described conditions of the alarm system are summarized in the table shown in FIG. 4. Clearly, four visual conditions are provided at each of the stations, namely no light emission, a pulsating green light, a constant red light or a pulsating red light, each of these visual conditions signifying the status of the alarm as above described. An optional fifth indication, namely a constant green, may be obtained by slight modification of the circuit, as to be described below.

As described above, the relay 42 becomes energized when the terminal of the relay coil 42*a* connected to the key switches is grounded or substantially lowered in potential. Since the key switches are connected between the relay coil 42*a* and the collector of the transistor 36, it is important that the collector of the transistor 36 be brought to zero potential or substantially decreased while one of the key switches is closed in order to change the condition of the relay contracts 42*b* and therefore the on or off condition of the alarm system. When the loop 16 is closed, and therefore a positive potential appears at the base of the transistor 36, and the potential at the collector drops substantially to ground level as described above. On the other hand, when the loop 16 is open, the base voltage fluctuates to raise and lower the collector voltage in a fluctuating manner substantially between ground level and the positive supply voltage $B^+$. In either case then, whether the loop 16 is closed or open, there appears at least brief periods or points when the collector voltage drops sufficiently in order to energize the relay coil 42*a* upon the closing of one of the key switches. In this connection, it may be mentioned that the frequency of pulsation as determined by the multi-vibrator 34 is selected to be in the range of a fraction of a cycle to several cycles per second. With this relatively low frequency, the on periods of the transistor are sufficiently long to energize the relay coil 42*a*. It has been found that such an arrangement of the relay coil 42*a* provides satisfactory results.

Based on the above, it will be evident that four distinct visual indications are provided at each of the stations, including the control station 12 and each of the remote stations, to signify different conditions of the alarm system 10. Additionally, each of the stations include a key switch which permits local or remote supervisory monitoring or control of the alarm system. All of these functions and indications are achieved by mere utilization of three conductors 23–25 which connect the remote stations to the central or control station 12. This relatively large number of functions has not heretofore been possible with such a low number of interconnecting leads of conductors.

As suggested above, an optional fifth indication may be obtained by slight modification of the circuit. Referring to FIG. 4, it will be noted that a constant current through $d_1$, which would provide a constant green indication, for example, was not one of the four modes earlier discussed. The operation previously discussed describes the base of the transistor 36 as either being at a constant positive potential, when the loop 16 is closed, or a pulsating potential which is only at the ground or reference potential during a small portion of each cycle. For this reason, the collector voltage is either fluctuating or nearly grounded with the circuit above described. In order to maintain the collector voltage at a constant positive level, the base must be grounded on a continuing basis. Now, closing the relay contacts 42*b* with the transistor in the "off" or non-conducting condition causes a constant current to flow through $d_1$ which, with the above described LED diodes, would provide a constant green indication. The manner of grounding the base is not in and of itself critical. For example, a switch can be connected to the base which grounds the same on the occurrence of any desired event, the occurrence of which is to be monitored. One condition which can advantageously be monitored at all remote locations is the condition of an additional time-delay loop which is used in some alarm systems. When the time delay loop is open, a switching circuit may be provided which automatically grounds the base of the transistor 36. Clearly, when the base is directly grounded, the collector voltage will remain at the high positive potential irrespective of the potentials appearing at the output of the multi-vibrator 34. Alternately, it may be possible to modify the multi-vibrator 34 so that it provides a grounded output when the specified fifth condition occurs.

What has been described above is a description of a presently preferred embodiment of the alarm system in accordance with the present invention. However, various changes may be made in the form, construction and arrangement of the parts herein described without departing from the spirit and scope of the invention and without sacrificing any of its advantages.

What is claimed:

1. In an alarm system including an alarm circuit and alarm sensing means the state of which is changeable between a non-alarm condition and an alarm condition, the improvement comprising pulsing means connected to said alarm sensing means for generating a substantially constant voltage in said non-alarm condition and a pulsating voltage in said alarm condition of said alarm sensing means; switch means for enabling and disabling the alarm circuit and for providing higher and lower reference voltage as a function of the enabled and disabled conditions of the alarm circuit; and indicating means connected between said pulsing and switching means and adapted to permit current flow in each of two opposite directions therethrough as a function of the relative voltages provided by both said pulsating and switching means across said indicating means, said indicating means providing a different indication for each of the two directions of current flow therethrough, whereby a total of at least four indications may be obtained by selective passage of currents through said indicating means which currents may flow in one of said two opposing directions and which may be zero, constant or pulsed in each of said directions to thereby provide said indications in either constant or in pulsed form.

2. In an alarm system as defined in claim 1, wherein the alarm sensing means is an electrically conductive loop which is current conductive in the non-alarm condition and non-conductive in the alarm condition, and wherein said pulsing means comprises means for generating a train of pulses only when the loop is open.

3. In an alarm system as defined in claim 2, wherein said pulse generating means comprises a multi-vibrator connected to the conductive loop.

4. In an alarm system as defined in claim 1, wherein said indicating means comprises a pair of light emitting means each of which permits passage of current in only one direction and emits light only when a current passes therethrough.

5. In an alarm system as defined in claim 4, wherein said pair of light emitting means comprises a pair of back-to-back LED diodes.

6. In an alarm system as defined in claim 4, wherein said light emitting means of each pair are selected to emit a different color light for each direction of current flow through said indicating means.

7. In an alarm system including an alarm circuit and alarm sensing means the state of which is changeable between a non-alarm condition and an alarm condition, the improvement comprising pulsing means connected to said alarm sensing means for generating a substantially constant voltage in said non-alarm condition and a pulsating voltage in said alarm condition of said alarm sensing means; first switch means for enabling and disabling the alarm circuit and for providing higher and lower reference voltages as a function of the enabled and disabled conditions of the alarm circuit; indicating means connected by means of two leads between said pulsing and first switching means and adapted to permit current flow in each of two opposite directions therethrough as a function of the relative voltages provided by both said pulsating and first switching means across said indicating means, said indicating means providing a different indication for each of the two directions of current flow therethrough; and second switch means connected by means of a third lead to said first switch means and further connected to one of said leads connecting said indicating means to said pulsing means for controlling the condition of said first switch means, whereby said indicating means and said second switch means are connected to said pulsing and first switch means by three leads and whereby a total of at least four indications may be obtained by selective passage of currents through said indicating means which currents may be zero, flow in one of said two opposing directions and which may be constant or pulsed in each of said directions to thereby provide said indications in constant or in pulsed form.

8. In an alarm system as defined in claim 7, wherein said indicating means comprises a pair of back-to-back LED diodes each of which emits a different color light.

9. In an alarm system as defined in claim 7, wherein one indicating means and second switch means are provided.

10. In an alarm system as defined in claim 7, wherein said alarm system has a central control which includes the alarm circuit, said pulsing and first switch means being at the location of the central control unit; and at least one remote control station including indicating and second switch means connected to said central control unit by said three leads.

11. In an alarm system as defined in claim 10, wherein a plurality of remote control stations are provided each having indicating means and second switch means, all said indicating means being connected in parallel to each other across said first mentioned two leads and all said second switch means being connected in parallel to each other across said one and third leads, whereby actuation of any one of said second switch means at any remote location modifies the condition of said first switch means at the central control unit, and current flow between said first mentioned two leads provides an indication by all said indicating means at all said remote control stations.

12. In an alarm system as defined in claim 7, wherein said first switch means comprises a ratchet relay the coil of which is connected to said third lead, whereby application of a voltage across said coil by actuation of said second switching means energizes said relay.

13. In an alarm system as defined in claim 12, wherein said relay has a pair of contacts which open and close with successive actuations of said relay, one of said contacts being connected to the alarm circuit reference or ground potential and the other contact is connected to a supply of voltage and to the other of said two leads, whereby the lower ground potential is applied to one terminal of said indicating means when said contacts are closed and the higher supply voltage is applied to said one indicating means terminal when said contacts are open.

* * * * *